United States Patent [19]

Beeghly

[11] 4,336,463

[45] * Jun. 22, 1982

[54] ANNUNCIATOR

[75] Inventor: Bruce R. Beeghly, Youngstown, Ohio

[73] Assignee: The Economy Engine Company, Youngstown, Ohio

[ * ] Notice: The portion of the term of this patent subsequent to Jan. 20, 1998, has been disclaimed.

[21] Appl. No.: 206,884

[22] Filed: Nov. 14, 1980

Related U.S. Application Data

[63] Continuation-in-part of Ser. No. 923,591, Jul. 12, 1978, Pat. No. 4,246,493, which is a continuation-in-part of Ser. No. 826,389, Aug. 22, 1977, abandoned.

[51] Int. Cl.[3] ..... H02J 9/06

[52] U.S. Cl. ..... 307/66; 307/116; 340/520

[58] Field of Search ..... 307/66, 116, 117, 118, 307/120, 154, 584; 340/181, 147 CN, 223, 520; 123/198 R, 198 D, 198 BD, 198 DC, 198 C; 180/103 R; 73/116

[56] References Cited

U.S. PATENT DOCUMENTS

| | | | |
|---|---|---|---|
| 3,264,613 | 8/1966 | Stolle | 340/415 |
| 3,841,291 | 10/1974 | Ludewig et al. | 123/198 DB |
| 3,872,473 | 3/1975 | Melgaard et al. | 340/415 |
| 3,960,011 | 1/1976 | Renz et al. | 73/116 |
| 3,965,469 | 6/1976 | Ryan | 340/415 |
| 4,074,255 | 2/1978 | Munt | 340/756 |
| 4,136,660 | 1/1979 | Palmer | 123/198 DC |

*Primary Examiner*—L. T. Hix
*Assistant Examiner*—S. D. Schreyer
*Attorney, Agent, or Firm*—Webb, Burden, Robinson & Webb

[57] ABSTRACT

A shut-down and first-out annunciator device comprising sensor switches that change condition when a fault occurs. Logic and display circuits provide a digital readout indicative of a fault condition. Shut-down means are responsive to a shut-down signal produced by the logic circuit and produce a latching signal for the display. A first power supply powers all sections during normal operation and a second power supply powers the display and shut-down circuits after shut-down.

12 Claims, 3 Drawing Figures

ANNUNCIATOR

RELATED CASE

Figure 1:
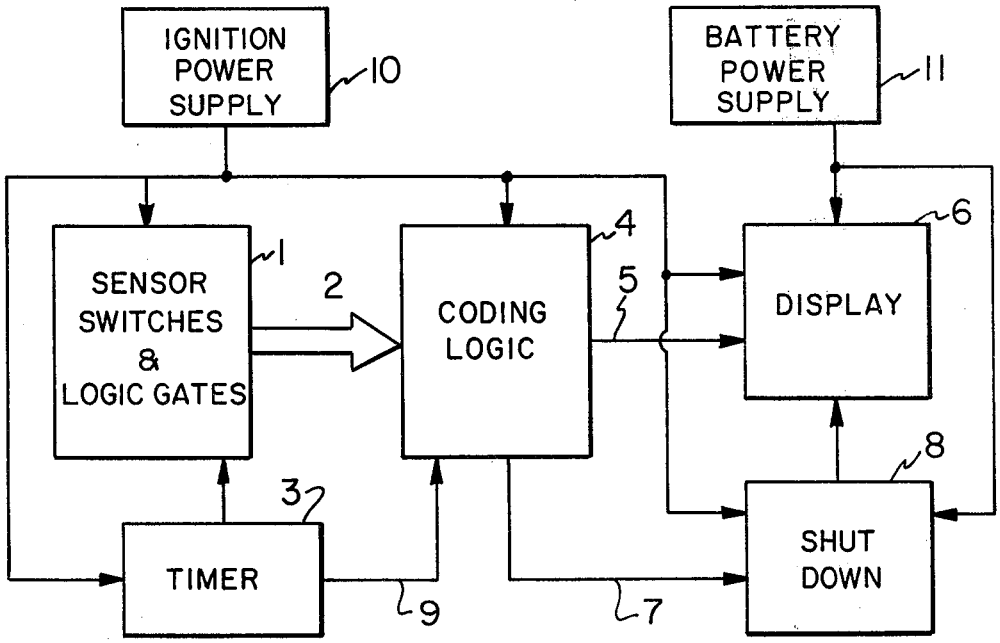

This application is a continuation-in-part of application Ser. No. 923,591, filed July 12, 1978, now U.S. Pat. No. 4,246,493 which itself was a continuation-in-part of Application Ser. No. 826,389, filed Aug. 22, 1977, abandoned.

This invention relates to a first-out annunciator and shut-down device useful for monitoring and shutting-down a remotely located internal combustion engine or the like. Related devices have been proposed and are described in patent literature. Some of the prior devices are electromechanical and some are electronically implemented (See, for example, U.S. Pat. Nos. 3,965,469 and 3,960,011). This application relates to an improved electronically operated first-out annunciator and shut-down device.

It is an advantage according to this invention that the device draws very low current under all operating conditions, thereby enabling it to be operated from the self-powered ignition of the engine being monitored and a small long-life battery.

It is a further advantage of this invention that a numeral corresponding to the sensor switch first sending a fault signal is displayed on a digital display device.

It is yet another advantage according to this invention that all sensors can be tested without shutting-down or causing shut-down of the engine with which it is associated.

It is an advantage according to this invention that the engine cannot be restarted until after a reset switch has been pressed. Hence, an operator unfamiliar with the annunciator cannot start the engine wiping out the stored information regarding prior shut-down.

The application discloses an improvement in the annunciator circuit disclosed and claimed in my U.S. Patent Application Ser. No. 923,591, filed July 12, 1978 entitled "Annunciator".

Briefly, according to this invention there is provided a shut-down and first-out annunciator device for an internal combustion engine or the like comprising a plurality of parallel connected sensor switches. The sensor switches change condition when a fault condition occurs in the monitored device, such as low oil pressure, high coolant temperature, etc. A digital logic circuit converts the change in condition on one of the sensor switches into a binary output indicative of the sensor switch which has changed condition. The logic circuit also creates a shut-down signal when any sensor switch changes condition. A digital display means converts the binary signal produced by the logic circuit into a digital readout and includes the usual BCD-to-seven-segment numeral drivers which have a latch terminal for fixing the output when the latch terminal is provided a low signal. A shut-down circuit is responsive to the shut-down signal produced by the logic circuit for closing a switching device which grounds the ignition system, for example. The switching device has a very high input impedance and a breakdown voltage exceeding the maximum primary voltage. The shut-down circuit creates latching signals for latching the digital display and the shut-down switch.

According to preferred embodiments, the shut-down circuit can be disabled to permit testing of the individual sensor switches without shut-down of the engine and latching of the display. It is also preferred that the shut-down circuit converts the shut-down signal produced by the logic circuit into a continuous latch and shut-down signal with a slight time delay between the start of the logic circuit shut-down signal and the continuous latch and shut-down signal.

The shut-down and first-out annunciator device according to this invention includes a first power supply. This may be the ignition system, for example, supplying power from the storage capacitor of a capacitive discharge ignition system or from the primary of an inductive break-type ignition system. The first power supply operates the sensor switches, the logic circuit, the display means and the shut-down means during normal operation. The annunciator device is also provided with a second power supply circuit comprising a battery for operating the display means in the shut-down circuit after shut-down. In this way, after shut-down, the numeral corresponding to the first-out sensor switch remains displayed on the display and latched by the shut-down circuit.

Figure 2:
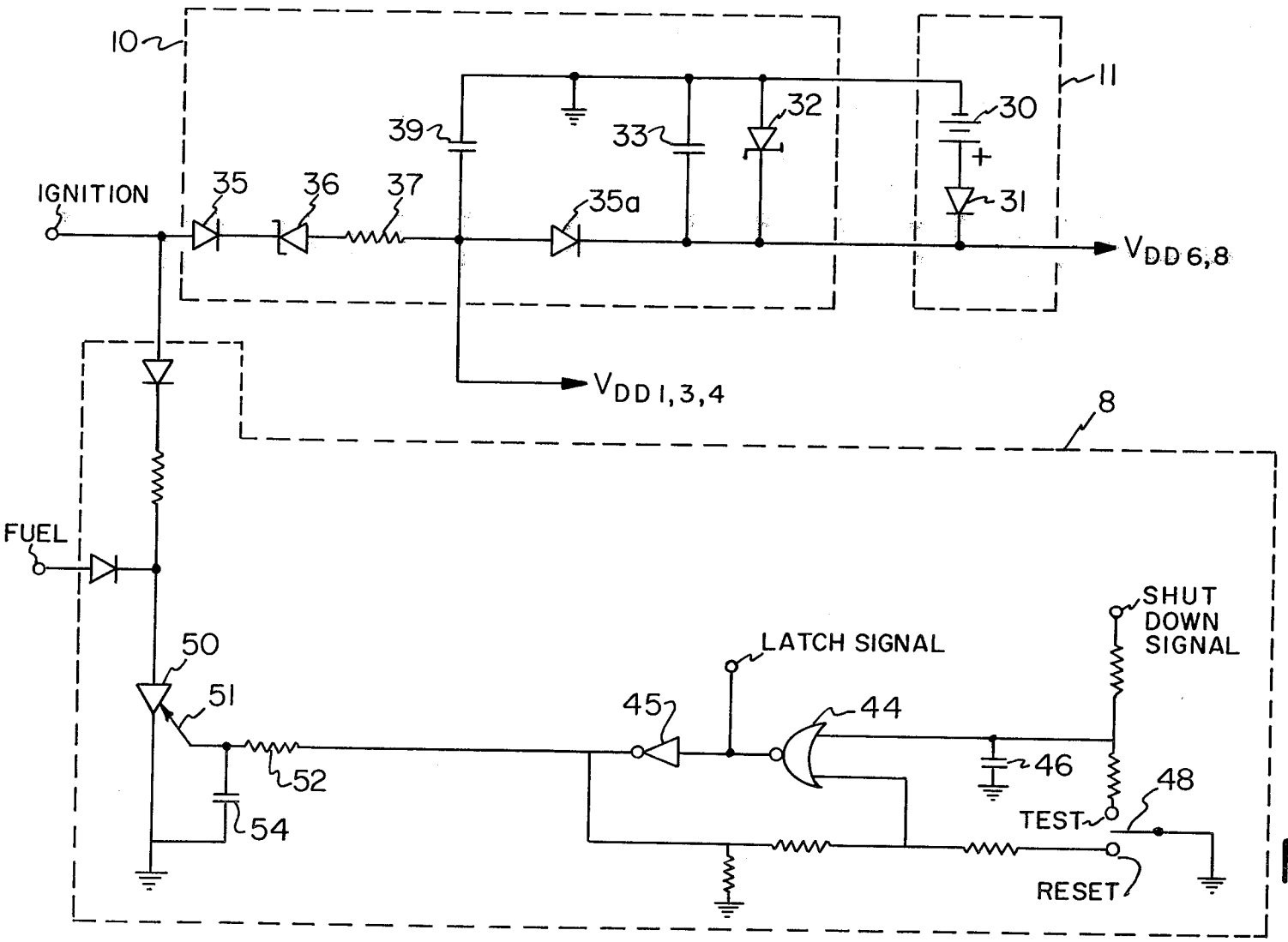
Figure 3:
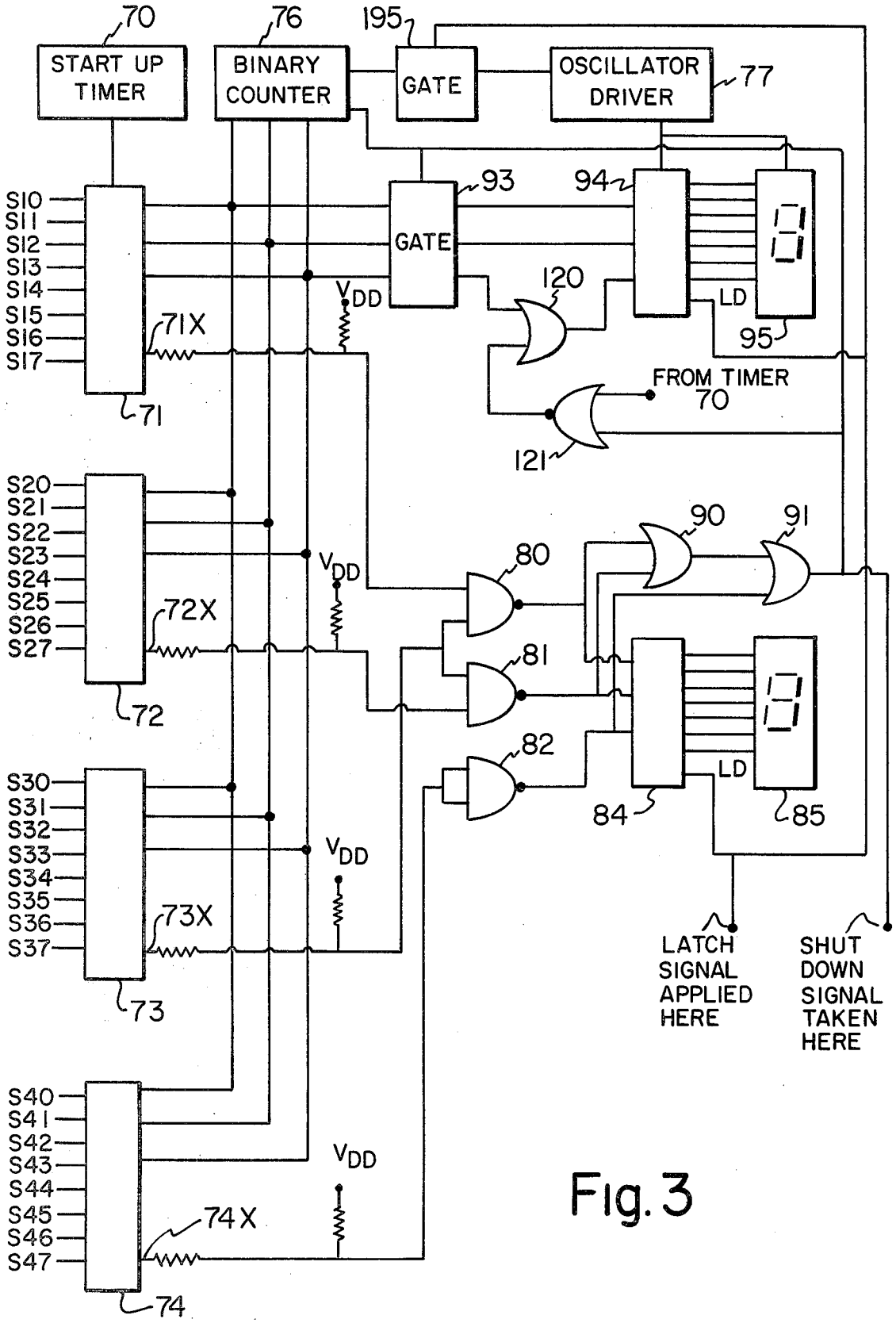

Further features and other objects and advantages of this invention will become clear from the following detailed description made with reference to the drawings in which FIG. 1 is an overall schematic illustrating the interrelationship of the various sections of the shut-down and first-out annunciator device according to this invention, FIG. 2 is a circuit diagram illustrating the first power supply circuit, the second power supply circuit and the shut-down circuit according to this invention, and FIG. 3 is a circuit diagram of part of a circuit useful in an embodiment wherein a large number of sensor switches can be monitored.

Referring now to FIG. 1, there is shown a block diagram illustrating the interconnection of various sections of the annunciator and shut-down device according to this invention. Section 1 comprising the sensor switches and logic gates provides discrete outputs for each of the plurality of activated sensor switches (i.e., producing a fault signal). Hence, the output of section 1 is a bus 2 having a plurality of lines. During start-up, it is necessary to ignore the fault signals produced by certain sensors (i.e., oil pressure) and hence, timer 3 outputs a disable signal that is used to cancel the fault signal of certain sensors at start-up.

The coding logic section 4 of the device converts the signals on bus 2 into binary coded decimal (BCD) signals. The output bus 5 of the logic circuit lines is applied to the display section 6. The logic circuit performs other functions. It outputs a shut-down signal on line 7 if any sensor switch generates a fault signal. The shut-down signal is applied to the shut-down section 8. The logic circuit generates a "0" output when the timer is shutting-out selected sensor fault signals. For this, line 9 connects timer 3 to logic section 4. The logic section generates a "1" when there is no longer a disable signal outputted from the timer and no sensor switches have changed condition, that is are producing fault signals. To display only the first sensor to fault (on shut-down any number of sensor switches will change condition), the display is latched by a latch signal produced by the shut-down section 8.

The device has two power supply sections. In a preferred embodiment, the first power supply 10 derives energy from the ignition during operation and provides power to the entire circuit during operation of the engine. It may simply comprise diode rectifiers and filtering capacitors. The battery power supply 11 provides power to the display section 6 after shut-down to maintain the digital display and to the shut-down section to maintain the latching signal.

The display section basically comprises a square wave oscillator, two drivers and a two place liquid crystal display or LCD (one for the tens place and one for the units place). The LCD is the preferred display means due to its very low current requirement.

The shut-down circuit 8 basically comprises a switch having a very high input impedance and which must have an input signal continuously applied to its control element during the entire conducting period which grounds the ignition circuit when its control element is energized. The shut-down circuit also produces continuous shut-down and latching signals in response to the temporary shut-down signal produced by the logic section which continuous signals can only be terminated by a reset signal.

With reference to FIG. 2, the shut-down 8 and power supply circuits 10 and 11 are described. Battery supply circuit 11 comprises a battery 30 and a protective diode 31. The battery will only supply energy to the display section 6 and the shut-down section 8 when the ignition power supply is no longer capable of outputting power. During operation of the engine when the power supply 10 is operating the voltage at the cathode of diode 31 is higher than the battery voltage and therefore the battery cannot discharge. The battery operates only when the engine is shut-down to supply about 15 microamps. This is accomplished by having the battery supply current to only that part of the circuit that latches the display and the display itself. Available lithium nonrechargeable batteries can give life of five years under these circumstances and the use of such batteries or the like is contemplated.

The power supply which supplies all the various sections of the shut-down and first-out annunciator device according to this invention during engine operation is comprised of diode 35, zener diode 36, resistor 37 and capacitor 39 for supply line $V_{DD}$1, 3, 4, and diode 35*a*, capacitor 33 and zener diode 32 for supplying line $V_{DD}$6, 8. The input to the power supply 10 is the ignition, for example, the storage capacitor of a capacitive discharge ignition system or primary winding of an inductive break-type ignition system. Because the device is designed to use very little power at all times, it is possible to power the circuit from self-powered ignition systems, that is those having no auxiliary power source (such as a battery). These ignition systems are powered by DC current generators, alternators and magnetos.

The shut-down section receives the shut-down signal produced by the logic circuit. This signal is created by the logic circuit when a sensor switch changes condition. It is a temporary signal in the sense that since the logic circuit is unpowered after shut-down, it must cease after shut-down. The shut-down section produces continuous shut-down and latch signals from the temporary shut-down signal received from the logic circuit. This is accomplished by NOR gate 44 and INVERTER 45. The shut-down signal is applied to one input of the NOR gate. The output of the NOR gate 44 is applied to the INVERTER 45. The output of the INVERTER 45 is fedback through a resistor to the other input of the NOR gate 44. The feedback circuit is grounded through a very large resistor. Hence, during normal operation when no shut-down signal is received from the logic section both inputs to the NOR gate are low and the output is therefore high. The output of the NOR gate 44 is applied to the latch terminals on the drivers in the display section placing the drivers in the unlatched condition. When a shut-down signal is received, a high is applied to one input of NOR gate 44, thus driving the output low. The low output is inverted by the INVERTER 45 and fedback to the other input to the NOR gate 44 thus latching the output of the NOR gate 44 low. The NOR gate 44 output remains low notwithstanding the shut-down signal received from the logic circuit may no longer be high. The latched low output of NOR gate 44 is applied to the latching terminal on the drivers in the display section thus latching the digital output so as to display the numeral corresponding to the first-out sensor switch. To assure that the numeral of the faulting sensor switch is displayed before the latched signal is applied, a small delay capacitor 46 is placed between the input terminal receiving the shut-down signal on the NOR gate 44 and ground.

A mechanical reset and test switch 48 is provided to ground the feedback input to the NOR gate 44 through a resistor thereby unlatching the NOR gate 44 and INVERTER 45. The same mechanical switch 48 can be used to ground the input to the NOR gate 44 which receives the shut-down signal thus providing test condition. When the switch is in the test position, the various sensor switches can be checked without shutting-down the engine or latching the display. An operator, when the switch 48 is in the test position, can manually change the condition of individual sensor switches and observe the numeral corresponding to that switch displayed on the digital output. The above functions of switching the described points to ground may also be accomplished by electronic means.

The basic shut-down element of the shut-down circuit of FIG. 2 is electronic switch 50 which may be, for example, a power field effect transistor (power FET). The power FET is connected with its drain (or source) grounded and its source (or drain) connected through diodes to the ignition system and the electrical fuel system if desirable. When the power FET is triggered on by a positive going signal applied to its gate 51, a circuit to ground is provided for the ignition and fuel systems thus shutting-down the engine. Resistor 52 and capacitor 54 are all common elements in the control circuit of the power FET and prevent it from being triggered by transients. Note that the power FET 50 has a very high input impedance and therefore maintaining the shutdown signal at the gate 51 of the power FET drains insignificant amounts of power from the battery. Because the shutdown signal is maintained at the gate 51, without resetting at 48, the engine cannot be restarted. Thus one unfamiliar with the annunciator and shutdown system cannot walk up to the engine and start it.

As is known to anyone skilled in the art, the various NOR, OR, NAND, and INVERTER gates as well as the BCD encoders and the timer, oscillator and LCD drivers are available from various manufacturers as integrated circuits. It is also well known that different combinations of the logic gates can be functional equivalents of the specific combinations shown in this specification. Set forth in the following table is a listing of the various components which applicant has used in constructing one actual embodiment of this invention.

| ELEMENT | COMMERCIAL I.C. |
|---|---|
| OR Gate | Motorola MC 14071 |
| NOR Gate | Motorola MC 14001 |
| NAND Gate | Motorola MC 14011 |
| Driver | Motorola MC 14543 |
| Timer | Motorola MC 14541 |
| Oscillator | RCA CD 4047 |
| Display | Hamlin 3906 |

A preferred embodiment of this annunciator is illustrated in FIG. 3. In this embodiment, each parallel sensor switch ($S_{10}$-$S_{17}$; $S_{20}$-$S_{27}$; $S_{30}$-$S_{37}$; and $S_{40}$-$S_{47}$) is associated with one input of a multiplexer (71, 72, 73, 74) which in response to a BCD input connects one of said multiplexer inputs to a common output (71*x*, 72*x*, 73*x*, 74*x*). A suitable multiplexer has been found to be the Motorola MC14051. The BCD bus supplying binary inputs to the multiplexers is controlled by a binary counter 76, clocked by oscillator divider 77. A suitable binary counter has been found to be Motorola MC14520. The oscillator 77 may also supply power for driving drivers 84 and 94 and liquid crystal displays 85 and 95. Hence, each multiplexer continually and sequentially poles the parallel inputs. During start-up, the start-up timer 70 disables one multiplexer.

The grounding of any sensor switch, say $S_{30}$, causes the common output 73*x* of the associated multiplexer 73 to be pulled down. It is normally high due to a pull-up resistor, for example, as shown in the Figure connected to $V_{DD}$. This low is inverted and passed through the coding logic comprising NAND gates 80, 81, and 82 to the tens display driver 84. Thus the tens display driver is coded, in this example, to cause a three to be displayed on a seven-segment display 85. Any high output of the coding network (80, 81 and 82) results in a high at the output of OR gate 91 as a result of the manner in which OR gates 90 and 91 are connected. Thus, a temporary shut-down signal is produced. This signal is applied to gate 93 allowing the BCD output of the binary counter to be applied to the units display driver. The shut-down signal is also applied to binary counter 76 to hold the count.

The NOR gate 121 and OR gate 120 work to apply a binary coded signal resulting in a "00" display during the start-up when the timer is outputting a high to cause disregard of sensors $S_{10}$ to $S_{17}$ and to provide a binary coded decimal signal resulting in a "01" display when all the sensors are on-line.

A temporary shut-down signal is converted into a latching signal which causes the drivers 84, 94 to latch the display corresponding to the first-out sensor switch. The latch signal is applied to the gate 195 to isolate the binary counter 76 from the oscillator 77.

As used in the specification and claims the term "power-FET" refers to a large area MOSFET (Metal Oxide Semiconductor Insulated Gate Field Effect Transistor). MOSFET have very high input resistance at the gates thereof. Recent fabrication advances have permitted the design of large area MOSFETS that have source-drain breakdown voltages in excess of 150 V. The source-drain blocking voltage must be at least as high as the voltage in the primary circuit which typically ranges from about 150 V up to 400 V. Suitable power-FET include devices based on technology called HEXFET, for example, the International Rutifier Corp.'s IRF 350 rated at 400 V and 11 amps continuous and 22 amp pulsed and the same company's IRF 330 rated as 400 V and 4 amp continuous, 8 amp pulsed.

Having thus described the invention with the detail and particularity required by the Patent Laws, what is desired protected by Letters Patent is set forth in the following claims.

I claim:

1. A shut-down and first-out annunciator device for an internal combustion engine or the like comprising:

a. a plurality of parallel connected sensor switches which change condition when a fault condition occurs, b. a logic circuit which converts the change in condition on one of the plurality of sensor switches into a binary digital output indicative of the sensor switch which has changed condition and for creating a temporary shut-down signal, c. a digital display means for converting the binary digital signal produced by the logic circuit into a digital readout, d. shut-down means responsive to the temporary shut-down signal for creating continuous signals for latching the digital display and power FET having a control element by application of the signal to said control element, e. a first power supply circuit outputting energy only during normal operation to power the sensor switches, logic means, display means and shut-down means during normal operation, and f. a second power circuit comprising a battery for powering during and after shut-down a portion of the device including the display means and shut-down means but excluding the sensor switches.

2. A shut-down and first-out annunciator device according to claim 1 further including a timer producing a signal during start-up which prevents the logic circuit from recognizing the condition of one or more sensor switches.

3. A shut-down and first-out annunciator device according to claim 2 wherein the logic circuit outputs a selected binary digital signal during the start-up period, another selected binary digital signal after the start-up when no fault condition exists or a binary digital signal indicative of a sensor switch which has changed condition.

4. A shut-down and first-out annunciator device according to claim 1 wherein the shut-down means in response to said temporary shut-down signal from the logic means creates said continuous shut-down and latching signals such that they can only be terminated by a reset signal.

5. A shut-down and first-out annunciator device according to claim 4 wherein the shut-down means imposes a slight delay between the start of the temporary shut-down signal produced by the logic circuit and the continuous shut-down and latching signal, thus insuring time for the display means to display the digital read-out indicative of the sensor switch that has changed condition.

6. A shut-down and first-out annunciator device according to claim 4 wherein a test signal disables the shut-down means whereby each sensor switch may be tested without causing shut-down.

7. A shut-down and first-out annunciator device according to claim 3 wherein the logic circuit comprises means for converting the output of the sensor switches into binary coded decimal signals and also means for producing a work select signal whenever there exists output from any sensor switch, a two input NOR gate to which the timer input and select signal are applied, a two input OR gate to which the output of the NOR gate and the lowest binary terminal of the converting means are connected whereby the logic circuit will output a BCD "0" during the start-up period and a BCD "1" during the period thereafter if no fault condition exists.

8. A shut-down and first-out annunciator device according to claim 4 wherein the shut-down means further comprising a two input NOR gate, the output of which is connected to an INVERTER, said temporary shut-down signal being applied to one of the inputs on the NOR gate, a feedback circuit from the output of said INVERTER being applied to the other input of said NOR gate such that a high temporary shut-down signal latches the NOR gate output low and the INVERTER output high.

9. A shut-down and first-out annunciator device according to claim 8 comprising a small grounded capacitor fixed to that input of the NOR gate to which the temporary shut-down signal is applied whereby a delay in the creation of the latched output of the NOR gate is effected.

10. A shut-down and first-out annunciator device according to claim 7 wherein the feedback terminal of the NOR gate is placed at ground to reset the shut-down circuit.

11. A shut-down and first-out annunciator device according to claim 7 wherein the terminal of the NOR gate receiving the temporary shut-down signal may be placed at ground whereby each sensor switch may be tested without causing shut-down.

12. A shut-down and first-out annunciator device according to claim 2 wherein each sensor switch in a first group of sensor switches is connected to a first multiplexer and each sensor switch in at least one other group of sensor switches is connected to a multiplexer associated with said at least one other group, a binary counter for outputting binary select signals to said multiplexers to pole the sensor switches, the common output of each of said multiplexers being applied to a decoding network to control a higher place display in the digital display and to produce a temporary shut-down and latch signal, the output of said binary counter also gated to the digital display in response to the temporary shut-down to control a units place display.

* * * * *